US011087707B2

(12) United States Patent
Guo et al.

(10) Patent No.: US 11,087,707 B2
(45) Date of Patent: Aug. 10, 2021

(54) DRIVING METHOD AND DEVICE FOR GOA CIRCUIT, AND DISPLAY DEVICE

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Lei Guo, Beijing (CN); Shuai Xu, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/634,339

(22) PCT Filed: May 23, 2019

(86) PCT No.: PCT/CN2019/088151
§ 371 (c)(1),
(2) Date: Jan. 27, 2020

(87) PCT Pub. No.: WO2019/228249
PCT Pub. Date: Dec. 5, 2019

(65) Prior Publication Data

US 2021/0090517 A1 Mar. 25, 2021

(30) Foreign Application Priority Data

May 28, 2018 (CN) ..... 201810522096.6

(51) Int. Cl.
*G09G 3/36* (2006.01)

(52) U.S. Cl.
CPC ... *G09G 3/3677* (2013.01); *G09G 2300/0408* (2013.01); *G09G 2310/08* (2013.01)

(58) Field of Classification Search
None
See application file for complete search history.

(56) References Cited

U.S. PATENT DOCUMENTS

2012/0133628 A1* 5/2012 Kim ..... G09G 3/3688 345/208
2015/0062200 A1 3/2015 Yang et al.
(Continued)

FOREIGN PATENT DOCUMENTS

CN 102479495 A 5/2012
CN 103413537 A 11/2013
(Continued)

OTHER PUBLICATIONS

International Search Report of PCT/CN2019/088151 in Chinese, dated Aug. 23, 2019, with English translation.
(Continued)

*Primary Examiner* — Aneeta Yodichkas
(74) *Attorney, Agent, or Firm* — Collard & Roe, P.C.

(57) ABSTRACT

A driving method and device for a GOA circuit, and a display device. The driving method includes: reducing a clock signal frequency of the GOA circuit to 1/M of an original clock signal frequency, in a case where data signals of one frame of image satisfy a frequency reduction condition. The frequency reduction condition includes that the data signals of the one frame of image is capable of being equally divided into M parts in time sequence, data signals of each of the M parts are the same, and M is an integer and M≥2.

16 Claims, 4 Drawing Sheets

(56) References Cited

U.S. PATENT DOCUMENTS

| | | | | |
|---|---|---|---|---|
| 2015/0187334 | A1 | 7/2015 | Oh et al. | |
| 2017/0076701 | A1 | 3/2017 | Hu et al. | |
| 2018/0102105 | A1* | 4/2018 | Aoki | G06F 3/1423 |
| 2018/0174551 | A1* | 6/2018 | Ansari | G09G 5/12 |
| 2018/0197455 | A1 | 7/2018 | Han et al. | |

FOREIGN PATENT DOCUMENTS

| | | | |
|---|---|---|---|
| CN | 103915076 | A | 7/2014 |
| CN | 104751758 | A | 7/2015 |
| CN | 105070220 | A | 11/2015 |
| CN | 106504722 | A | 3/2017 |
| CN | 106710563 | A | 5/2017 |
| CN | 106847209 | A | 6/2017 |
| CN | 105070220 | B | 11/2017 |
| CN | 107678721 | A | 2/2018 |
| CN | 107808651 | A | 3/2018 |
| CN | 108470551 | A | 8/2018 |
| EP | 3 605 517 | A1 | 2/2020 |
| KR | 10-2004-0017047 | A | 2/2004 |

OTHER PUBLICATIONS

Ohinese Office Action in Chinese Application No. 201810522096.6, dated Jun. 21, 2019 with English translation.

* cited by examiner

DRIVING METHOD AND DEVICE FOR GOA CIRCUIT, AND DISPLAY DEVICE

CROSS-REFERENCE TO RELATED APPLICATION

This application is the National Stage of PCT/CN2019/088151 filed on May 23, 2019, which claims priority under 35 U.S.C. § 119 of Chinese Application No. 201810522096.6 filed on May 28, 2018, the disclosure of which is incorporated by reference.

TECHNICAL FIELD

Embodiments of the present disclosure relate to a driving method and a driving device for a GOA circuit and a display device.

BACKGROUND

In recent years, GOA (Gate Driver on Array) technology has been widely used in LCDs (Liquid Crystal Displays). That is, a gate switching circuit of a TFT (Thin Film Transistor) is integrated in a non-display area of a LCD to form a GOA circuit, thereby achieving a narrow bezel design.

SUMMARY

At least one embodiment of the present disclosure provides a driving method for a gate driver on array (GOA) circuit, the driving method including:

reducing a clock signal frequency of the GOA circuit to 1/M of an original clock signal frequency, in a case where data signals of one frame of image satisfy a frequency reduction condition, wherein the frequency reduction condition comprises that the data signals of the one frame of image is capable of being equally divided into M parts in time sequence, data signals of each of the M parts are the same, and M is an integer and M≥2.

Optionally, the driving method according to at least one embodiment of the present disclosure further includes: maintaining a refresh frequency of the GOA circuit unchanged in a case where the data signals of the one frame of image satisfy the frequency reduction condition.

Optionally, the driving method according to at least one embodiment of the present disclosure further includes: maintaining a refresh frequency of the GOA circuit unchanged and controlling the clock signal frequency of the GOA circuit to be the original clock signal frequency, in a case where the data signals of the one frame of image do not satisfy the frequency reduction condition.

Optionally, the reducing the clock signal frequency of the GOA circuit to 1/M of the original clock signal frequency, in a case where the data signals of the one frame of image satisfy the frequency reduction condition, includes:

reducing the clock signal frequency of the GOA circuit to ½ of the original clock signal frequency, in a case where the data signals of the one frame of image satisfy a condition that data signals of a first half frame of image are the same as data signals of a second half frame of image.

Optionally, the driving method according to at least one embodiment of the present disclosure further includes further includes: controlling blank time between adjacent frames of images to be zero.

At least one embodiment of the present disclosure further provides a driving device for a gate driver on array (GOA) circuit, which includes a control sub-circuit configured to reduce a clock signal frequency of the GOA circuit to 1/M of an original clock signal frequency in a case where data signals of one frame of image satisfy a frequency reduction condition, wherein the frequency reduction condition comprises that the data signals of the one frame of image is capable of being equally divided into M parts in time sequence, data signals of each of the M parts are the same, and M is an integer and M≥2.

Optionally, in the driving device according to at least one embodiment of the present disclosure, the control sub-circuit is further configured to maintain a refresh frequency of the GOA circuit unchanged in a case where the data signals of the one frame of image satisfy the frequency reduction condition.

Optionally, in the driving device according to at least one embodiment of the present disclosure, the control sub-circuit is further configured to, in a case where the data signals of the one frame of image do not satisfy the frequency reduction condition, maintain the refresh frequency of the GOA circuit unchanged and control the clock signal frequency of the GOA circuit to be the original clock signal frequency.

Optionally, in the driving device according to at least one embodiment of the present disclosure, the control sub-circuit is further configured to: reduce the clock signal frequency of the GOA circuit to ½ of the original clock signal frequency, in a case where the data signals of the one frame of image satisfy a condition that data signals of a first half frame of image are the same as data signals of a second half frame of image.

Optionally, in the driving device according to at least one embodiment of the present disclosure, the control sub-circuit is further configured to control blank time between adjacent frames of images to be zero.

Optionally, the driving device according to at least one embodiment of the present disclosure further includes a determining sub-circuit in signal connection with the control sub-circuit signal, wherein the determining sub-circuit is configured to determine whether the data signals of the one frame of image satisfy the frequency reduction condition and output a determination result to the control sub-circuit.

At least one embodiment of the present disclosure further provides a display device, which includes any above-mentioned driving device for the GOA circuit.

At least one embodiment of the present disclosure further provides a driving method for a gate driver on array (GOA) circuit, which includes:

providing data signals of a first frame of image and reducing a clock signal frequency of the GOA circuit to a 1/M of an original clock signal frequency, wherein data signals of the first frame of image is capable of being equally divided into M parts in time sequence, data signals of each of the M parts are the same, and M is an integer and M≥2.

For example, the driving method according to at least one embodiment of the present disclosure further includes: maintaining a refresh frequency of the GOA circuit unchanged.

For example, the driving method according to at least one embodiment of the present disclosure further includes:

providing data signals of a second frame of image, maintaining the refresh frequency of the GOA circuit unchanged and controlling the clock signal frequency of the GOA circuit to be the original clock signal frequency, wherein the data signals of the second frame of image is not capable of being equally divided into M parts in time sequence.

For example, in the driving method according to at least one embodiment of the present disclosure, M=2.

For example, the driving method according to at least one embodiment of the present disclosure further includes: controlling blank time between adjacent frames of images to be zero.

BRIEF DESCRIPTION OF THE DRAWINGS

In order to clearly illustrate the technical solution of the embodiments of the present disclosure, the drawings of the embodiments will be briefly described in the following; it is obvious that the described drawings are only related to some embodiments of the present disclosure and thus are not limitative of the present disclosure.

DETAILED DESCRIPTION

In order to make objects, technical details and advantages of the embodiments of the present disclosure apparent, the technical solutions of the embodiments will be described in a clearly and fully understandable way in connection with the drawings related to the embodiments of the present disclosure. Apparently, the described embodiments are just a part but not all of the embodiments of the present disclosure. Based on the described embodiments herein, those skilled in the art can obtain other embodiment(s), without any inventive work, which should be within the scope of the present disclosure.

Figure 1:
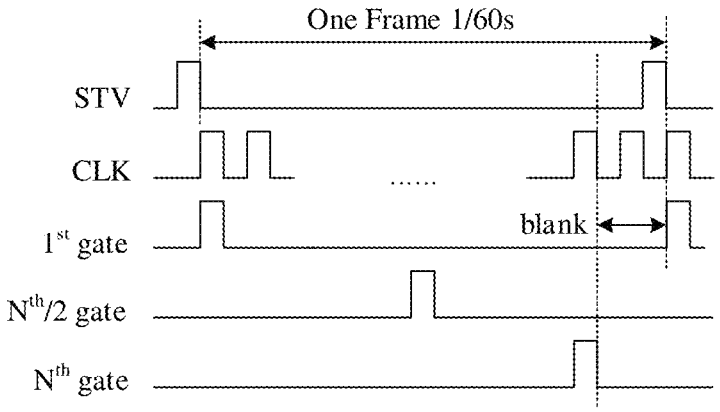
FIG. 1 is a timing diagram of driving a GOA circuit.

As an example for illustration, an LCD includes 2000 cascaded GOA units, has a refresh frequency of 60 Hz, and 8 CLK signals in one clock cycle. As shown in FIG. 1, scan time for one frame of image is 1/60 s, and the above 2000 rows of gate lines all are scanned once in the scan time for each frame of image. Therefore, in order to drive the GOA circuit to operate, an IC (Integrated Circuit) outputs clock signals for 250 times, each of which is composed of 8 CLK signals. That is, the IC outputs 8 CLK signals of a high frequency without interruption, which will reduce the life of the IC.

An embodiment of the present disclosure provides a driving method for a GOA circuit, including: in a case where data signals of one frame of image (for example, source signals input to a data line connected to a source electrode of a driving transistor in a display panel) satisfy a frequency reduction condition, reducing the clock signal frequency of the GOA circuit to 1/M of an original clock signal frequency. The frequency reduction condition includes that: data signals of one frame of image can be equally divided into M parts in time sequence, and the data signals of each part are the same, where M is an integer and M≥2. Herein, the original clock signal frequency may refer to a clock signal frequency preset for the GOA circuit. It should be noted that, first, for the GOA circuit, i.e., the gate driving circuit composed of a plurality of cascaded GOA units, a gate scanning signal output by each stage of GOA unit can control turning on each row of gate line; and when a gate line corresponding to a row of pixels is turned on, a data signal can be input to the row of pixels through a data line corresponding to the pixel, thereby driving the row of pixels to perform a display operation. As known to those skilled in the art, a display image of the display panel is generally controlled by data signals of each frame of image. Those skilled in the art can understand that in a case where data signals of one frame of image satisfy the frequency reduction condition, i.e., the condition that data signals of one frame of image can be equally divided into M parts in time sequence, and the data signals of each part are the same, in this case, taking M=2 as an example, when the display panel displays an image at this time, the upper half screen and the lower half screen display the same picture.

Second, the refresh frequency of the GOA circuit refers to a number of times an image is refreshed per second. In the embodiments of the present disclosure, in a case where data signals of one frame of image satisfy the frequency reduction condition, the refresh frequency of the GOA circuit does not change, that is, the frequency of the start signal STV of each frame of image does not change. Generally, the clock signal is used as an output signal of the GOA circuit, that is, output as a gate scan signal to each row of gate line. Therefore, the frequency of the clock signal determines the turning on duration of each row of gate line of the display panel, that is, the charging time of each row of pixels.

Figure 2:
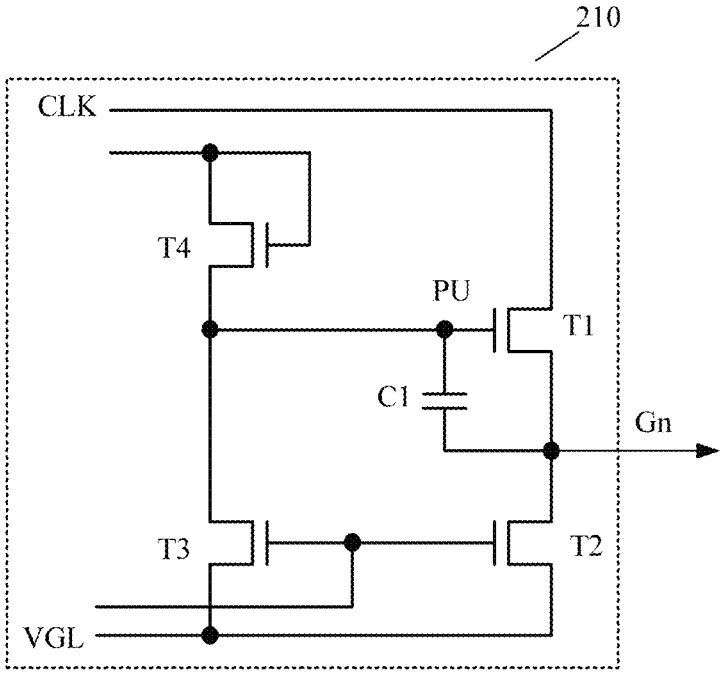
FIG. 2 is a schematic circuit structure diagram of an exemplary GOA unit.

FIG. 2 is a circuit structure diagram of an exemplary GOA unit. For example, the GOA unit is an n-th stage of the GOA circuit. As shown in FIG. 2, the GOA unit 210 includes a first transistor T1, a second transistor T2, a third transistor T3, a fourth transistor T4, and a storage capacitor C1.

The first transistor T1 in the GOA unit 210 is an output transistor at a signal output terminal of the GOA unit 210. For example, the first transistor T1 has a first electrode connected to a clock signal CLK, and a second electrode connected to a first electrode of the second transistor T2 to form the output terminal of the GOA unit 210, and to allow outputting a gate scan signal Gn for the n-th row of pixel units (the signal is a square wave pulse signal, the pulse part has a turning-on level and the non-pulse part has a turning-off level) as an input signal for the next stage GOA unit 210. The first transistor T1 has a gate electrode connected to a first node PU, thus connecting a first electrode of the third transistor T3 and a second electrode of the fourth transistor T4.

The second transistor T2 has a second electrode connected to a second electrode of the third transistor T3 and a low-level signal VGL. The second transistor T2 has a gate electrode connected to the gate electrode of the third transistor T3 and an output terminal of the GOA unit 210 of the next row (that is, the (n+1)th row), to receive a gate scan signal G(n+1) as an output pull-down control signal. The first electrode of the second transistor T2 is connected to the second electrode of the first transistor T1, so the second transistor T2 can be turned on under the control of the output pull-down control signal, to pull down the output signal at the output terminal to a low-level signal VGL without outputting a gate scan signal Gn.

The third transistor T3 has a first electrode which is also connected to the first node PU and thus is electrically connected to the second electrode of the fourth transistor T4 and the gate electrode of the first transistor T1. A second electrode of the third transistor T3 is connected to the low-level signal VGL, and a gate electrode of the third transistor T3 is also connected to the output terminal of the GOA unit 210 of the next row (that is, the (n+1)th row), to receive the gate scan signal G(n+1) as the reset control signal (which is also the output pull-down control signal), so that the third transistor T3 can be turned on under the control of the reset control signal to reset the first node PU to the low-level signal VGL, thereby turning off the first transistor T1.

The fourth transistor T4 has a first electrode connected to a gate electrode of the fourth transistor T4 and to an output terminal of the GOA unit 210 of the previous row (that is, the (n−1)th row) to receive the gate scan signal G(n−1) as the input signal (and the input control signal), and a second electrode connected to the first node PU, so as to charge the first node PU when the fourth transistor T4 is turned on, so that the voltage of the first node PU can turn on the first transistor T1, thereby enabling the clock signal CLK to be output through the output terminal. The storage capacitor C1 has an terminal connected to the gate electrode of the first transistor T1 (that is, the first node PU), and another terminal connected to the second electrode of the first transistor T1, so as to store the voltage of the first node PU and to further pull up, when the first transistor T1 is turned on to output signals, the voltage of the first node PU by its own bootstrap effect to improve an output performance When the GOA circuit composed of the cascaded GOA units 210 shown in FIG. 2 operates, in a case where the gate scan signal G(n−1) is at a high level, the fourth transistor T4 is turned on and charges the first node PU. The rising level of the first node PU causes the first transistor T1 to be turned on, so the clock signal CLK can be output at the output terminal through the first transistor T1, that is, the gate scan signal Gn is equal to the clock signal CLK. When the clock signal CLK is at a high level, the gate scan signal Gn also outputs a high level. When the gate scan signal Gn is at a high level, the GOA unit 210 of the GOA circuit inputs the high-level signal Gn to the gate line GL of a corresponding row, so that gate electrodes of the thin film transistors in all the pixel units corresponding to the row of gate line GL are applied with the signal to turn on those thin film transistors. The data signal is input to the liquid crystal capacitor of the corresponding pixel unit through the thin film transistor in each pixel, so as to charge the liquid crystal capacitor in the corresponding pixel unit, thereby implementing writing and holding of the signal voltage of the pixel unit. When the gate scan signal G(n+1) is at a high level, the second transistor T2 and the third transistor T3 are turned on, to achieve the effects of resetting the first node PU and pulling down the output terminal. Therefore, through the GOA circuit, for example, a progressive scan driving function can be realized.

Since the source and drain electrodes of each of the above-mentioned transistors are symmetrical with respect to each other, the source and drain electrodes thereof can be interchanged. The first electrode may be, for example, a source electrode or a drain electrode, and the second electrode may be, for example, a drain electrode or a source electrode. In the present disclosure, the source and drain electrodes of a thin film transistor are collectively referred to as "source/drain electrode." For example, each of the above transistors may be an N-type transistor. Certainly, the above transistors are not limited to N-type transistors, and it is possible that at least a part of the above transistors are P-type transistors. Therefore, the polarities of the corresponding turn-on signal and the output scan signal may be changed accordingly.

It should be noted that, in the embodiments of the present disclosure, the structure of the GOA unit 210 of the GOA circuit is not limited to the structure described above. The GOA unit 210 of the GOA circuit may adopt any applicable structure, and may also include more or less transistors and/or capacitors, for example, sub-circuits for implementing functions such as first node control, noise reduction, etc., which is not limited in the embodiments of the present disclosure.

Figure 3:
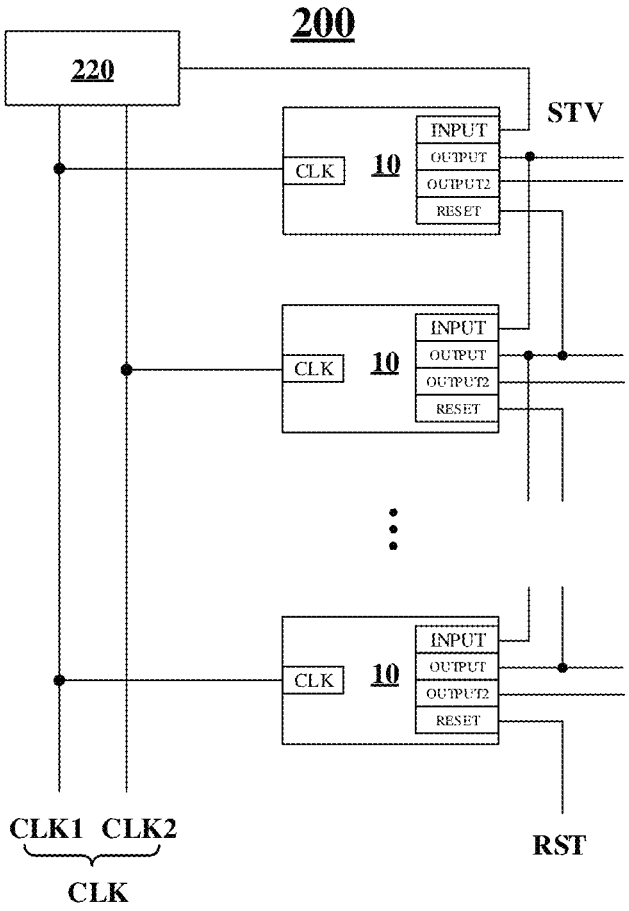
FIG. 3 is a schematic circuit structure diagram of an exemplary GOA circuit.

FIG. 3 is a schematic circuit structure diagram of an exemplary GOA circuit. As shown in FIG. 3, the GOA circuit 200 includes a plurality of cascaded GOA units 10. For example, the GOA unit 10 may be the GOA unit 210 described above. The GOA circuit 200 can be directly integrated on an array substrate of a display device by using the same process as a thin film transistor, for example, to realize a progressive scan driving function.

For example, as shown in FIG. 3, except the GOA unit of the first stage, each of the input terminals INPUT of the GOA units of other stages is connected to the first output terminal OUTPUT of the GOA unit of the previous stage; and except the GOA unit of the last stage, each of the reset terminals RESET of the GOA units of other stages is connected to the first output terminal OUTPUT of the GOA unit of the next stage. For example, the input terminal INPUT of the GOA unit of the first stage may be configured to receive a trigger signal STV, and the reset terminal RESET of the GOA unit of the last stage may be configured to receive a reset signal RST.

For example, as shown in FIG. 3, the GOA unit of each stage is configured to output a corresponding scan driving signal in response to the clock signal CLK. The clock signal CLK may include different clock signals CLK1 and CLK2, for example.

For example, as shown in FIG. 3, the GOA circuit 200 may further include a timing controller 220. The timing controller 220 is configured to provide clock signals CLK to the GOA units of various stages, and the timing controller 220 may also be configured to provide a trigger signal STV and a reset signal RST.

It should be noted that the embodiments of the present disclosure include but are not limited to the scenario shown in FIG. 3. The timing controller 220 may also be configured to provide four different clock signals to the GOA units at all stages through four clock signal lines, which is not limited in the embodiments of the present disclosure.

It should be noted that, in the embodiment of the present disclosure, if a GOA unit B is a GOA unit of a next stage with respect to another GOA unit A, the gate scan signal output by the GOA unit B is later in timing than the gate scan signal output by the GOA unit A. Correspondingly, if a GOA unit B is a GOA unit of the previous stage with respect to another GOA unit A, the gate scan signal output by the GOA unit B is earlier in timing than the gate scan signal output by GOA unit A.

However, it should be understood that the GOA unit shown in FIG. 2 and the GOA circuit shown in FIG. 3 are merely exemplary, and the embodiments of the present disclosure are not limited thereto. The driving method provided by the embodiment of the present disclosure can be applied to various forms of GOA circuits.

In the driving method provided by the embodiments of the present disclosure, the clock signal frequency of the GOA circuit is reduced in a case where the data signals of one frame of image satisfy the frequency reduction condition. Since the clock signal is usually output by the IC in the display panel, the driving method provided by the example can reduce the frequency of the IC outputting clock signals, thereby extending the life of the IC.

In some embodiments, the driving method may further include: maintaining the refresh frequency of the GOA circuit unchanged if the data signals of one frame of image satisfy the frequency reduction condition. However, it should be understood that, in other embodiments, in a case where the data signals of one frame of image satisfy the frequency reduction condition, while reducing the clock signal frequency of the GOA circuit to 1/M of the original clock signal frequency, the refresh frequency of the GOA circuit can also be reduced, which is not limited in the embodiments of the present disclosure. In the following, description will be made with reference to the example in which in a case where the data signals of one frame of image satisfy the frequency reduction condition, the refresh frequency of the GOA circuit unchanged is maintained unchanged.

In view of the above, it is known to those skilled in the art that there is usually a time period from when the gate line is turned off to when the data signal is inverted. Since the gate line of the previous row cannot be turned off instantly, the control signal requires a time period to fall down, and the turning on of the gate line of the next row also requires a time period. However, if the turning on of the next line is faster than the turning off of the previous line, it will cause a faulty operation, which will charge data signals of the next row to the previous row. In order to prevent incorrect charging during this time period, GOE time is usually provided in driving the GOA circuit, where the GOE time refers to a time period starting from the falling edge of the gate driving signal of the current row to the rising edge of the data driving signal of the next row. The driving method provided by the embodiment of the present disclosure reduces the clock signal frequency of the GOA circuit in a case where the data signals of one frame of image satisfy the frequency reduction condition, so the charging time of each row of pixels can be increased, while more sufficient GOE time can be reserved, thereby avoiding the occurrence of many charging-related defects.

The driving method provided by the embodiments of the present disclosure will be described in detail in combination with specific embodiments below. For example, in a case where the data signals of one frame of image satisfy the condition that the data signals of the first half frame of image are the same as the data signals of the second half frame of image, the refresh frequency of the GOA circuit is controlled to remain unchanged, and the frequency of the clock signal of the GOA circuit is controlled to be reduced to ½ of the frequency of the original clock signal. For example, when the same picture (such as a grayscale picture, FLK, HLine) is displayed on the upper and lower half screens of the display panel, the GOA circuit can be driven with the driving method provided in the embodiment of the present disclosure. Here, FLK and HLine display alternating black and white lines. At this time, it can be considered that the data signals of the first half frame of image and the second half frame of image in one frame of image are the same.

Figure 4:
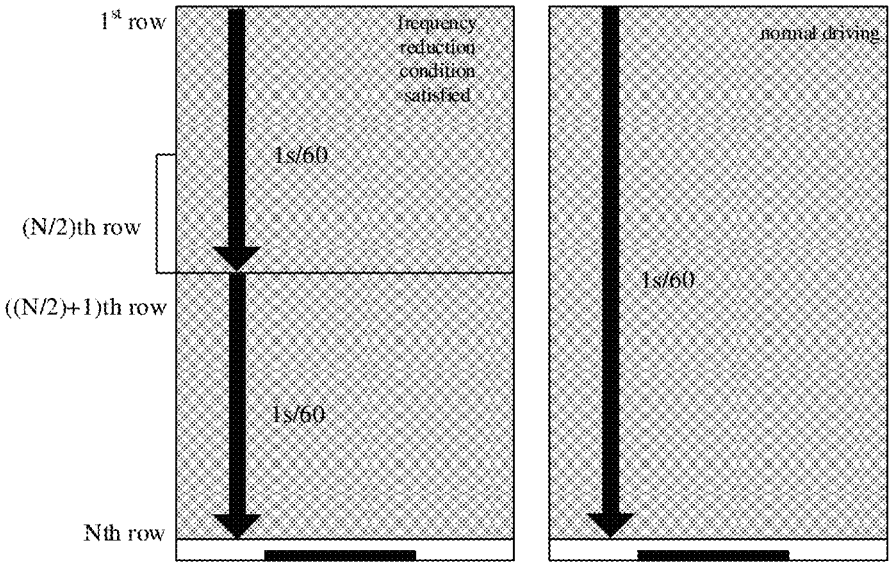
FIG. 4 is a schematic diagram of a comparison of scanning directions of a grate line respectively when a frequency reduction condition is satisfied and when being driven normally.

Specifically, it is assumed that the refresh frequency of the GOA circuit (assuming N cascaded GOA units) is 1/60 Hz, and the frequency of the original clock signal is ¼ Hz. FIG. 4 is a schematic diagram of a comparison of scanning directions of a grate line respectively in a case where a frequency reduction condition is satisfied and in a normal driving case.

Figure 5:
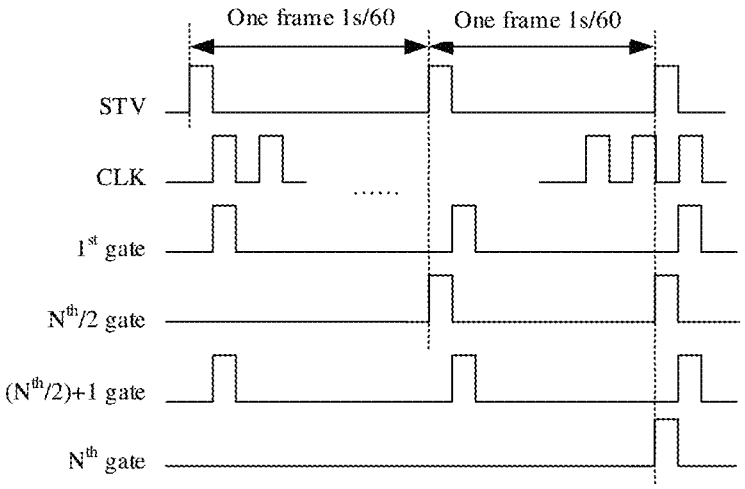
FIG. 5 is a timing diagram of driving a GOA circuit according to at least one embodiment of the present disclosure.

According to FIG. 4, when being driven normally, the GOA circuit sequentially scans the gate lines from the 1st row to the Nth row; and when the frequency reduction condition is satisfied, it switches to the driving method provided in the embodiment of the present disclosure (for example, when it is detected that the frequency reduction condition is satisfied, the switching is performed automatically, but it should be understood that the switching can also be performed manually, which is not limited in the embodiments of the present disclosure). Specifically, the refresh frequency of the control GOA circuit is maintained unchanged, and the frequency of the control clock signal is reduced to ½ of the original clock signal frequency, that is, the new clock signal frequency is ⅛ Hz. At this time, as shown in FIG. 5, when the start signal STV of the first frame of image arrives, the gate lines in the display panel are turned on sequentially starting from the first row. Since the clock signal frequency is reduced by half, when the gate line of the (N/2)th row is turned on, the start signal STV of the second frame of image arrives. At this time, the first-stage GOA unit is turned on again. Since the GOA units of the various stages in the GOA circuit are cascaded, after the gate line of the (N/2)th row is turned on, the gate line of the ((N/2)+1) th row is turned on immediately after the gate line of the (N/2)th row. In this way, as shown in FIG. 4, the upper and lower half screens of the display panel are similarly divided into two independent small screens, and each small screen is sequentially refreshed from top to bottom.

In this case, compared with other driving methods, on one hand, the clock signal frequency of the GOA circuit of the driving method provided in this embodiment is reduced to 1/M of the original clock signal frequency, and the refresh frequency is not changed, so that the high-level duration of the clock signal (that is, the turning on duration of the gate line of each row) can be longer, and the corresponding pixel charging time is longer. Therefore, the above driving method can reserve enough GOE time to avoid the occurrence of defects related to insufficient charging. On the other hand, since the clock signal frequency is reduced, the frequency of the clock signals output by the IC can be reduced, thereby extending the life of the IC.

It should be noted that the above-mentioned operation of reducing the clock signal frequency of the GOA circuit is implemented only in a case where the data signals of one frame of image satisfy the frequency reduction condition. For example, M=2, that is, in a case where data signals in the first half frame of image and the second half frame of image are the same, the voltages on the data lines of the upper half screen and of the lower half screen do not change, so even if the gate lines of the upper and lower half screens are turned on at the same time, no phenomenon of chaos image will occur.

In view of the above, after the display of one frame of image is completed, if it is detected that the data signals of the next frame of image do not satisfy the above frequency reduction condition, optionally, the driving method provided by the embodiments of the present disclosure further includes maintaining the refresh frequency of the GOA circuit unchanged, and controlling the clock signal frequency of the GOA circuit as the original clock signal frequency. That is, in a case where the frequency reduction condition is not satisfied, for example, in a case where the next frame of image is a color image to be displayed, it will be switched back to the normal driving sequence, thereby improving the practicability of the driving method provided by the embodiment of the present disclosure. In some embodiments, maintaining the refresh frequency of the GOA circuit unchanged may be making the refresh frequency of the GOA circuit be a preset refresh frequency of the GOA circuit.

In addition, for high-load images such as HLine and 1dot, specifically, for such kind of screens, on the same data line, the gray levels displayed by pixels in adjacent rows above and below are not the same, thereby resulting in that data signals require being inverted and changed in each line. The load of the IC that outputs the data signals is large. When applying the driving method provided in the embodiments of the present disclosure to drive the GOA circuit, the display panel can be divided into M parts and data signals are input to each part at the same time. Since M≥2, the frequency of the data signals is reduced to at least ½ of the original frequency, which can reduce the load of the output module in the IC.

In view of the above, it is known to those skilled in the art that, as shown in FIG. 1, the normal driving sequence of the GOA circuit includes blank time BLANK, that is, after the display of one frame of image finishes, there is certain blank time before the next frame of image is started. Taking the above M=2 as an example, during the blank time BLANK, no gate line is turned on in the display panel, so black strips are likely to appear in the middle of the screen, which affects the display effect.

To solve this problem, optionally, the driving method provided in the embodiments of the present disclosure further includes: as shown in FIG. 5, controlling a blank time (Blank) between adjacent frames of images to 0. In this case, taking the above M=2 as an example, since the driving method controls the blank time (Blank) between adjacent frames of images to be 0, when the signal of the first frame of image is scanned to the last row of grate lines, the start signal STV of the next frame of image arrives, thereby avoiding the phenomenon of black strips between adjacent frame of images.

In addition, it should be noted that the display panel can be divided to even smaller parts according to the characteristics of the data signals when the IC driving capability and the performance of the GOA circuit allow. For example, the above M can also be 4 or 8, and so on. In this case, the frequency of the IC outputting clock signal may be further reduced, which is beneficial to further extending the life of the IC.

At least one embodiment of the present disclosure also provides a driving method for a GOA circuit, including: providing data signals of a first frame of image, and reducing a clock signal frequency of the GOA circuit to a 1/M of an original clock signal frequency, wherein the data signals of the first frame of image can be equally divided into M parts in time sequence, and the data signals of each of the parts are the same, where M is an integer and M≥2.

In some embodiments, the driving method may further include: maintaining a refresh frequency of the GOA circuit unchanged. However, it should be understood that in other embodiments, in a case where the data signals of the first frame of image satisfy the frequency reduction condition, it is also possible to reduce the refresh frequency of the GOA circuit, while reducing the clock signal frequency of the GOA circuit to 1/M of the original clock signal frequency, which is not limited in the embodiments of the present disclosure.

In some embodiments, M may be any real number greater than or equal to 2, such as 2, 3, 4, 5, 6, 7, 8, 9, 10, etc., according to actual requirements.

In some embodiments, the driving method may further include: controlling blank time between adjacent frames of images to be 0. This can avoid the phenomenon of black strips between adjacent frames of images.

In some embodiments, the driving method may further include: providing data signals of a second frame of image, and maintaining the refresh frequency of the GOA circuit unchanged and controlling the clock signal frequency of the GOA circuit to an original clock signal frequency, wherein the data signals of the second frame of image cannot be equally divided into M parts in time sequence. For example, when the next frame of image is a color image, it is switched back to the normal driving sequence, thereby improving the practicability of the driving method provided by the embodiment of the present disclosure.

Figure 6:
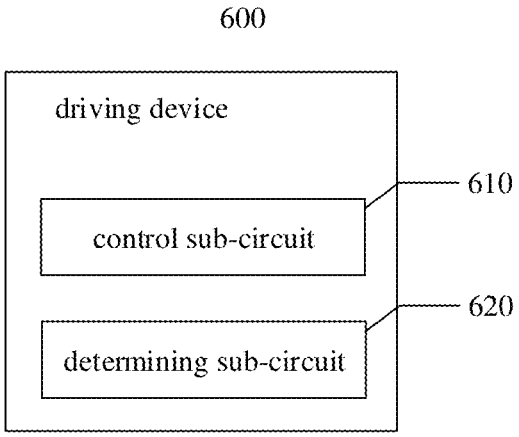
FIG. 6 is a schematic block diagram of a driving device for a GOA circuit according to at least one embodiment of the present disclosure.

At least one embodiment of the present disclosure also provides a driving device for a GOA circuit. As shown in FIG. 6, the driving device 600 includes a control sub-circuit 610, which is configured to in a case where data signals of one frame of image satisfy a frequency reduction condition, reduce a clock signal frequency of the GOA circuit to 1/M of an original clock signal frequency, wherein the frequency reduction condition includes that: data signals of one frame of image is capable of being equally divided into M parts in time sequence, and the data signals of each of the parts are the same, where M is an integer and M≥2.

The driving device provided by the embodiment of the present disclosure can reduce the clock signal frequency of the GOA circuit in a case where the data signals of one frame of image satisfy the frequency reduction condition. Since the clock signals are usually output by the IC in the display panel, the frequency of the IC outputting the clock signal can be reduced, thereby extending the life of the IC. At the same time, the charging time of each row of pixels can be increased, and more sufficient GOE time can be reserved, thereby avoiding the occurrence of many charging-related defects.

In addition, for high-load images such as HLine and 1dot, when applying the driving method provided by the embodiment of the present disclosure to drive the GOA circuit, the display panel can be divided into M parts and data signals can be input to each part at the same time. Since M≥2, the inversion frequency of the data signals is reduced to at least ½ of the original frequency, thereby reducing the load of the output module in the IC.

In some embodiments, the above-mentioned control sub-circuit 610 may be further configured to maintain the refresh frequency of the GOA circuit unchanged in a case where the data signals of one frame of image satisfy the frequency reduction condition. However, it should be understood that, in other embodiments, the above-mentioned control sub-circuit 610 may be further configured to: in a case where the data signals of one frame of image satisfy the frequency reduction condition, reduce the refresh frequency of the GOA circuit while reducing the clock signal frequency of the GOA circuit to 1/M of the original clock signal frequency, which is not limited in the embodiments of the present disclosure. In the following, description will be made with reference to the example in which when the data signals of one frame of image satisfy the frequency reduction condition, the refresh frequency of the GOA circuit is maintained unchanged.

In view of the above, optionally, the control sub-circuit 610 may also be configured to maintain the refresh frequency of the GOA circuit unchanged in a case where the data signals of one frame of image do not satisfy the frequency reduction condition, and control the clock signal frequency of the GOA circuit to be the original clock signal frequency. In some exemplary embodiments, the above-mentioned control sub-circuit 610 may be implemented as a frequency converter or a frequency conversion circuit formed by discrete components, and the like, which are not limited in the embodiments of the present disclosure.

Further, the driving device provided in the embodiments of the present disclosure may further include a determining sub-circuit 620 in signal connection with the control sub-circuit 610, and the determining sub-circuit 620 may be configured to determine whether data signals of one frame of image satisfy the frequency reduction condition, and output the determination result to the control sub-circuit 620. At this time, the control sub-circuit 620 can operate according to the above determination result. Signals between the control sub-circuit 610 and the determining sub-circuit 620 can be transmitted through a wired connection, a wireless connection, or the like. For example, signals can be transmitted through a wire connection, a Bluetooth connection, a Wi-Fi connection, a cellular network connection, a local area network connection, an Internet connection, etc., which is not limited in the embodiments of the present disclosure.

Optionally, the control sub-circuit 610 may also be configured to control blank time between adjacent frames of images to be 0. In this case, when the display panel is displayed, it can prevent black strips from appearing between adjacent frames of images, thereby improving the display effect of the display panel.

For example, taking M=2 as an example, in a case where the data signals of one frame of image satisfy the condition that the data signals of the first half frame of image are the same as the data signals of the second half frame of image, the control sub-circuit 610 is configured to control the refresh frequency of the GOA circuit to remain unchanged, and control the frequency of the clock signal of the GOA circuit to be reduced to ½ of the frequency of the original clock signal. Specifically, as shown in FIG. 5, when the start signal STV of the first frame of image arrives, the gate lines in the display panel are turned on sequentially starting from the first row. Since the clock signal frequency is reduced by half, when the gate line of the (N/2)th row is turned on, the start signal STV of the second frame of image arrives. At this time, the first-stage GOA unit is turned on again. Since the GOA units of the various stages in the GOA circuit are cascaded, after the gate line of the (N/2)th row is turned on, the gate line of the ((N/2)+1)th row is turned on immediately after the gate line of the (N/2)th row. In this way, as shown in FIG. 4, the upper and lower half screens of the display panel are similarly divided into two independent small screens, and each small screen is sequentially refreshed from top to bottom.

In some exemplary embodiments, the determining sub-circuit 620 may also be implemented in software, hardware, firmware, or combinations thereof. For example, the determining sub-circuit 620 may be implemented as a comparator or a comparison circuit formed by dicrete components, or the determining sub-circuit 620 may also be implemented manually by manually pressing a button or the like, which is not limited in the embodiments of the present disclosure.

In this case, compared with other driving methods, the GOA circuit is driven by the driving device provided by the embodiments of the present disclosure, on one hand, the clock signal frequency of the GOA circuit is reduced to 1/M of the original clock signal frequency while the refresh frequency is not changed. In this way, the high-level duration of the clock signal (that is, the turning on duration of the gate line of each row) can be longer, and the corresponding pixel charging time is longer. Therefore, applying the above driving device can reserve enough GOE time to avoid the occurrence of defects related to insufficient charging. On the other hand, since the clock signal frequency is reduced, the frequency of the clock signals output by the IC can be reduced, thereby extending the life of the IC.

It should be noted that the driving method and driving device of the GOA circuit according to the embodiments of the present disclosure may be implemented in software, hardware, firmware, or combinations thereof. For example, in the driving device 600 in the embodiment of the present disclosure, the control sub-circuit 610 and the determining sub-circuit 620 may be separately provided processors, or may be implemented by being integrated in a certain processor of the display panel, or may be implemented in a form of program codes stored in the memory of the display panel, and is called and executed by a processor of the display panel. The processor described herein may be a central processing unit (CPU), a graphics processor (Graphics Processing Unit, GPU) or a specific integrated circuit (Application Specific Integrated Circuit, ASIC), or an integrated circuit configured to implement the embodiments of the present disclosure.

Figure 7:
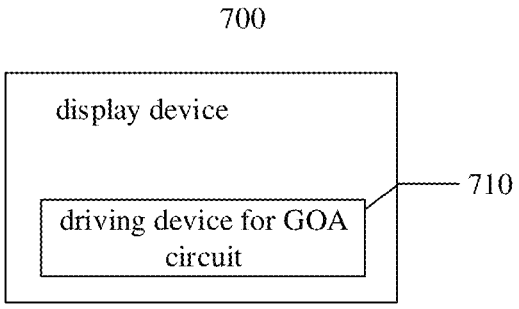
FIG. 7 is a schematic block diagram of a display device according to at least one embodiment of the present disclosure.

At least one embodiment of the present disclosure also provides a display device including any driving device as described above. As shown in FIG. 7, the display device 700 includes a driving device 710 for a GOA circuit, and the driving device 710 for the GOA circuit may be any one of the above driving devices. It should be noted that the display device 700 in this embodiment may be: a liquid crystal panel, a liquid crystal television, a display, an OLED panel, an OLED television, an electronic paper, a mobile phone, a tablet computer, a notebook computer, a digital photo frame, a navigator and any product or component with a displaying function. The display device 700 may further include other conventional components such as a display panel, which is not limited in the embodiments of the present disclosure.

What are described above is related to the illustrative embodiments of the disclosure only and not limitative to the scope of the disclosure; the scopes of the disclosure are defined by the accompanying claims.

What is claimed is:

1. A driving method for a gate driver on array (GOA) circuit, the driving method comprising:

reducing a clock signal frequency of the GOA circuit to 1/M of an original clock signal frequency, in a case where data signals of one frame of image satisfy a frequency reduction condition, wherein the frequency reduction condition comprises that the data signals of the one frame of image is capable of being equally divided into M parts in time sequence, data signals of each of the M parts are the same, and M is an integer and M≥2, wherein the reducing the clock signal frequency of the GOA circuit to 1/M of the original clock signal frequency, in the case where the data signals of the one frame of image satisfy the frequency reduction condition, comprises:

reducing the clock signal frequency of the GOA circuit to to ½ of the original clock signal frequency, in a case where the data signals of the one frame of image satisfy a condition that data signals of a first half frame of image are the same as data signals of a second half frame of image.

2. The driving method according to claim 1, further comprising:

maintaining a refresh frequency of the GOA circuit unchanged in a case where the data signals of the one frame of image satisfy the frequency reduction condition.

3. The driving method according to claim 2, further comprising:

controlling blank time between adjacent frames of images to be zero.

4. The driving method according to claim 1, further comprising:

maintaining a refresh frequency of the GOA circuit unchanged and controlling the clock signal frequency of the GOA circuit to be the original clock signal frequency, in a case where the data signals of the one frame of image do not satisfy the frequency reduction condition.

5. The driving method according to claim 1, further comprising:

controlling blank time between adjacent frames of images to be zero.

6. A driving device for a gate driver on array (GOA) circuit, the driving device comprising a control sub-circuit configured to reduce a clock signal frequency of the GOA circuit to 1/M of an original clock signal frequency in a case where data signals of one frame of image satisfy a frequency reduction condition, wherein the frequency reduction condition comprises that the data signals of the one frame of image is capable of being equally divided into M parts in time sequence, data signals of each of the M parts are the same, and M is an integer and M≤2, wherein the control sub-circuit is further configured to: reduce the clock signal frequency of the GOA circuit to to ½ of the original clock signal frequency, in a case where the data signals of the one frame of image satisfy a condition that data signals of a first half frame of image are the same as data signals of a second half frame of image.

7. The driving device according to claim 6, wherein the control sub-circuit is further configured to maintain a refresh frequency of the GOA circuit unchanged in a case where the data signals of the one frame of image satisfy the frequency reduction condition.

8. The driving device according to claim 6, wherein the control sub-circuit is further configured to, in a case where the data signals of the one frame of image do not satisfy the frequency reduction condition, maintain the refresh frequency of the GOA circuit unchanged and control the clock signal frequency of the GOA circuit to be the original clock signal frequency.

9. The driving device according to claim 6, wherein the control sub-circuit is further configured to control blank time between adjacent frames of images to be zero.

10. The driving device according to claim 6, further comprising a determining sub-circuit in signal connection with the control sub-circuit signal, wherein the determining sub-circuit is configured to determine whether the data signals of the one frame of image satisfy the frequency reduction condition and output a determination result to the control sub-circuit.

11. A display device, comprising the driving device for the GOA circuit according to claim 6.

12. A driving method for a gate driver on array (GOA) circuit, comprising:

providing data signals of a first frame of image, and reducing a clock signal frequency of the GOA circuit to 1/M of an original clock signal frequency, wherein data signals of the first frame of image is capable of being equally divided into M parts in time sequence, data signals of each of the M parts are the same, and M is an integer and M≥2, wherein the reducing the clock signal frequency of the GOA circuit to 1/M of the original clock signal frequency comprises:

reducing the clock signal frequency of the GOA circuit to to ½ of the original clock signal frequency, in a case where the data signals of the first frame of image satisfy a condition that data signals of a first half frame of image are the same as data signals of a second half frame of image.

13. The driving method according to claim 12, further comprising:

maintaining a refresh frequency of the GOA circuit unchanged.

14. The driving method according to claim 12, further comprising:

providing data signals of a second frame of image, and maintaining the refresh frequency of the GOA circuit unchanged and controlling the clock signal frequency of the GOA circuit to be the original clock signal frequency, wherein the data signals of the second frame of image is not capable of being equally divided into M parts in time sequence.

15. The driving method according to claim 12, wherein M=2.

16. The driving method according to claim 12, further comprising: controlling blank time between adjacent frames of images to be zero.

* * * * *